United States Patent [19]

Pink

[11] Patent Number: 4,870,836

[45] Date of Patent: Oct. 3, 1989

[54] AIR FLOW CONTROL FOR GLASS TOP REFRIGERATOR CONTAINER

[75] Inventor: John J. Pink, Cedar Rapids, Iowa

[73] Assignee: Amana Refrigeration, Inc., Amana, Iowa

[21] Appl. No.: 319,502

[22] Filed: Mar. 6, 1989

[51] Int. Cl.[4] ..... F25D 25/02

[52] U.S. Cl. ..... 62/382; 62/441

[58] Field of Search ..... 62/382, 302, 441; 312/330 R

[56] References Cited

U.S. PATENT DOCUMENTS

| | | | |
|---|---|---|---|
| 3,108,455 | 10/1963 | Hanson | 62/382 |
| 3,364,694 | 1/1968 | Cohen et al. | 62/382 X |
| 3,473,345 | 10/1969 | Pfeiffer et al. | 62/382 X |
| 3,600,905 | 8/1971 | Dymek et al. | 62/382 |
| 4,539,819 | 9/1985 | Alba et al. | 62/78 |
| 4,557,118 | 12/1985 | Pink et al. | 62/382 |
| 4,671,078 | 6/1987 | Pink | 62/408 |
| 4,732,014 | 3/1988 | Frohbieter | 62/382 |

*Primary Examiner*—Lloyd L. King

*Attorney, Agent, or Firm*—William R. Clark; Richard M. Sharkansky

[57] ABSTRACT

An air flow control mechanism for a glass top refrigerator container wherein a flexible actuator is routed from a lateral front slide in a guide slot or track that runs back along one side to a damper or shutter at the rear. Accordingly, a cold air inlet at the rear such as used in a meat keeper or crisper pan is actuated by a lateral front slide without having a mechanical linkage that passes across the middle of the frame thereby obstructing the view down into the container. The flexible band is coupled to an operator actuable lateral slide mechanism at the front, and the band at the back is coupled to a shutter which moves laterally in response to the motion of the slide mechanism so as to open and close the rear cold air inlet.

12 Claims, 4 Drawing Sheets

AIR FLOW CONTROL FOR GLASS TOP REFRIGERATOR CONTAINER

BACKGROUND OF THE INVENTION

The invention generally relates to refrigerators, and more particularly relates to air flow control mechanisms for storage drawers such as crisper pans and meat keepers.

As is well known, refrigerators generally have a variety of storage containers for maintaining different kinds of foods in ideal storage conditions. One type of storage container is a meat keeper, and the general purpose is to provide a storage region for meat and the like that is slightly colder than the rest of the refrigerated food compartment. For example, whereas the refrigerated food compartment is typically maintained at approximately 40° F., meat keepers may typically be kept 5°-8° F. cooler. One common embodiment for a meat keeper is defined by a meat container or drawer having an outer sleeve or sheath in which the container is slidably mounted. From an air inlet port at the rear of the meat keeper, chilled air is directed into the sleeve from a conduit coupled to a cold air duct behind the rear wall of the refrigerator liner. In one prior art meat keeper, a temperature control is provided by having a front lateral slide connected to a rearwardly extending actuator arm or linkage from which a damper plate is suspended. The damper plate has an aperture which permits the flow of cold air into the sleeve when it aligns with the air inlet port. When the damper plate is moved laterally by the actuator arm, the damper plate closes off the air inlet port in varying degrees.

Another type of storage container is a crisper pan that functions to create a storage environment having a higher humidity than the rest of the refrigerator food compartment. Accordingly, crisper pans are used to store vegetables and particularly moist, leafy vegetables that would dry out if left uncovered in the refrigerated food compartment. Air passageways may be provided at the front and back of the crisper pan so that an adjustable amount of cold air may be directed through the crisper pan by natural convection from rear-to-front so as to prevent leafy vegetables from becoming soggy. In one prior art embodiment, a laterally slidable gate is positioned at the front so as to open or close the front passageway in response to operator actuation. The front slide gate also has a rearwardly extending actuator arm that has a finger that engages a ramp of a lateral damper so as to synchronously open and close the rear passageway with the front passageway.

The above-described meat keeper and crisper pan air flow control mechanisms operate effectively. However, if the upper shelf of a meat keeper or crisper pan is made from an optically transparent material such as clear glass, the damper actuator arm obstructs the view of the contents of the drawer.

SUMMARY OF THE INVENTION

In accordance with the invention, the combination of elements includes a substantially rectangular horizontal frame adapted for supporting a slide-out food drawer in a refrigerator, the frame having a cover and a rear air inlet for receiving cold air, the frame further having a track extending from the front back along one side to the rear of the frame. Positioned along the track is a flexible band that is slideably engaged to the track and extends from the front of the frame back along the side to the rear of the frame. An operator actuable means for moving the flexible band along the track is provided at the front of the frame so that lateral motion of the band at the front imparts lateral motion of the band in the opposite direction at the rear of the frame. Connected to the band at the rear is a damper which is responsive to the lateral motion of the flexible band for opening and closing the rear air inlet. The operator actuable means may comprise a lateral slide having a handle. The invention has particular advantage when used with a cover that is visibly transparent. In one embodiment such as with a crisper pan, it is preferable that the damper means comprise a tapered end of the flexible band. In an alternate embodiment such as with a meat keeper, the damper may comprise a portion of the flexible band which has an aperture such that when the aperture is aligned with the rear air inlet, the damper is open. However, when the aperture is moved to one side, the rear air inlet is sealed by the damper. In one embodiment, the combination may include an outer sleeve spacedly encasing the drawer such as used with a meat keeper wherein the cold air from the rear inlet is directed into the space between the sleeve and the drawer. In another embodiment, the structure may further comprise a front passageway such as used to advantage with a crisper pan such that the front passage is opened and closed in synchronism with opening and closing the rear air inlet.

With such arrangement, the flexible band or actuator extends back along the side while a front lateral slide control is used. Accordingly, when the shelf is optically transparent, an actuator linkage is not visible extending from the front to the back across the top of the storage drawer. In short, a cold air damper at the rear of the drawer is actuated from the front without encumbering the user's view down through the glass shelf.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
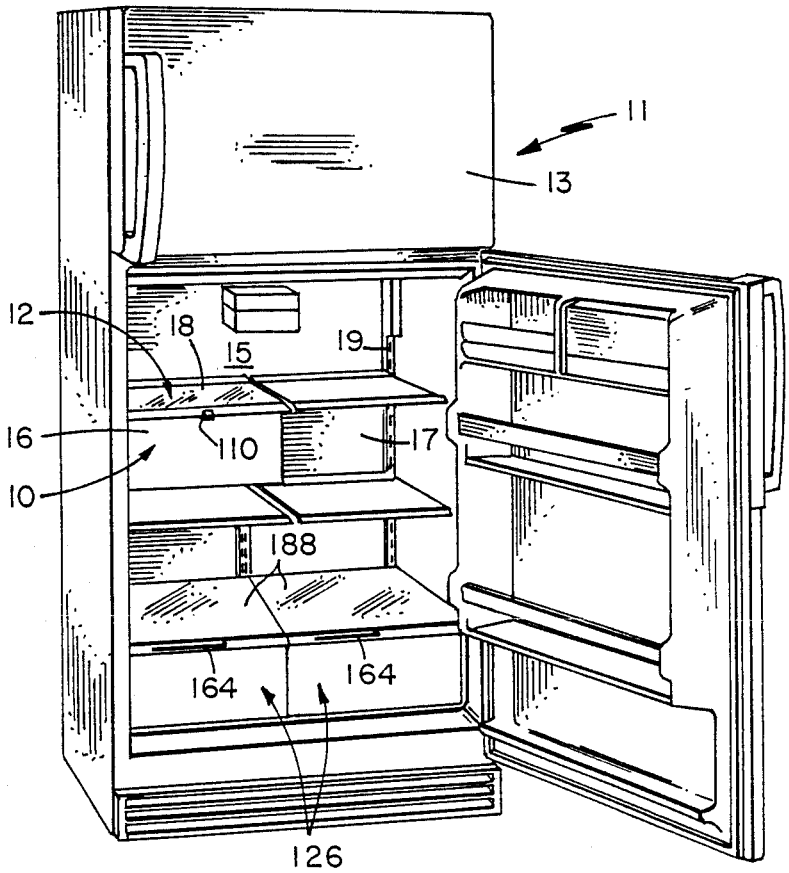
FIG. 1 is a perspective view of a refrigerator.

Referring to FIG. 1, refrigerator 11 is here shown as a top mount refrigerator with a freezer section 13 on the top and a refrigerated food compartment 15 on the bottom. In accordance with the invention, meat keeper 10 and crisper pans 126 have laterally slidable front control handles 110 and 164 that are respectively connected to bendable bands 58 (FIG. 3) and 166 (FIG. 4) that are routed in guide channels 84 and 180 or slots back along the sides 22 and 130 of frames 20 and 128. Lateral motion of the bendable bands at the rear actuates dampers 62 and 186 or shutters that control the air flow into the meat keeper 10 and crisper pans 164, respectively. As a result, the air flow into the back of the meat keeper 10 and the crisper pans 164 is adjustable from the front without having a mechanical linkage running through the central region of the supporting frames 20 and 128, respectively. Thus, clear glass covers 18 and 188 can be used without obstructing the top view down into the meat keeper 10 and crisper pans 164.

Figure 2:
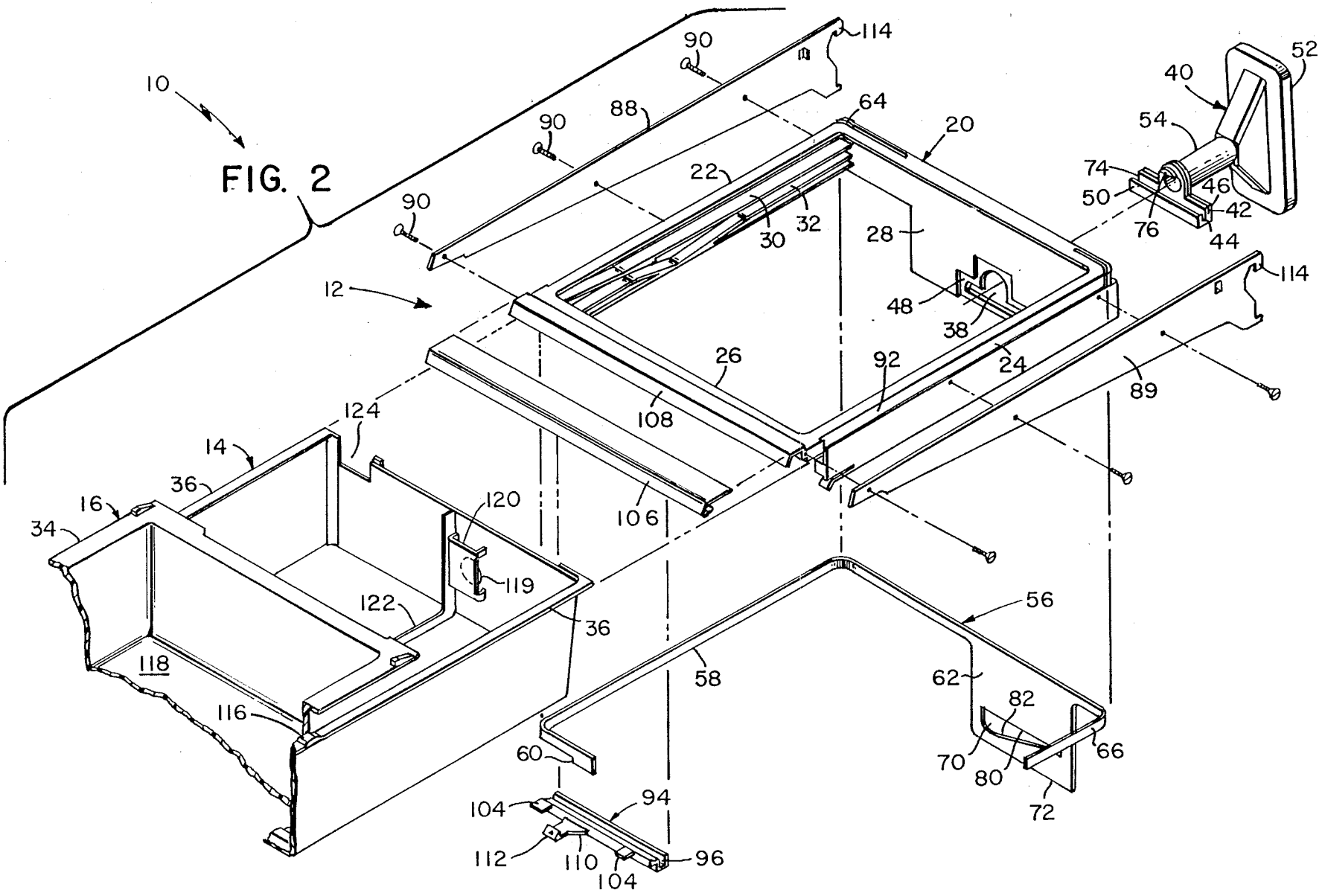
FIG. 2 is an exploded view of a meat keeper.

Referring to FIG. 2, meat keeper 10 is shown in an exploded view to include a shelf 12, sleeve 14 and meat keeper pan 16 or drawer. Shelf 12 generally includes a cover 18 (FIG. 1) and a meat keeper support frame 20. Here, frame 20 is a molded plastic part that is generally rectangular in shape and includes side members 22 and 24, with a front cross member 26 and a back cross panel 28. As shown, side members 22 and 24 have opposing slide channels 30 at the top for receiving runners 34 of pan 16 and slide channels 32 at the bottom for receiving runners 36 of sleeve 14.

Back cross panel 28 has an air inlet aperture 38 into which flexible conduit 40 mounts. More specifically, conduit 40 has a groove 42 between two parallel flanges 44 and 46 and snaps into aperture 38 with the inner flange 44 seating in recess 48 of panel 28. Keyed extensions 50 of conduit 40 mate with corresponding parts of aperture 38 thereby preventing conduit 40 from rotating with respect to frame 20. Conduit 40 has a rear mouth 52 that seats against the rear liner 17 (FIG. 1) of the refrigerated food compartment 15 and receives a flow of cold air from a duct (not shown) therebehind. The cold air is conveyed along throat 54 and through aperture 38 into meat keeper 10. For a more complete description of conduit 40 and the source and flow of cold air, see U.S. Pat. No. 4,671,078 which is hereby incorporated by reference.

Figure 3:
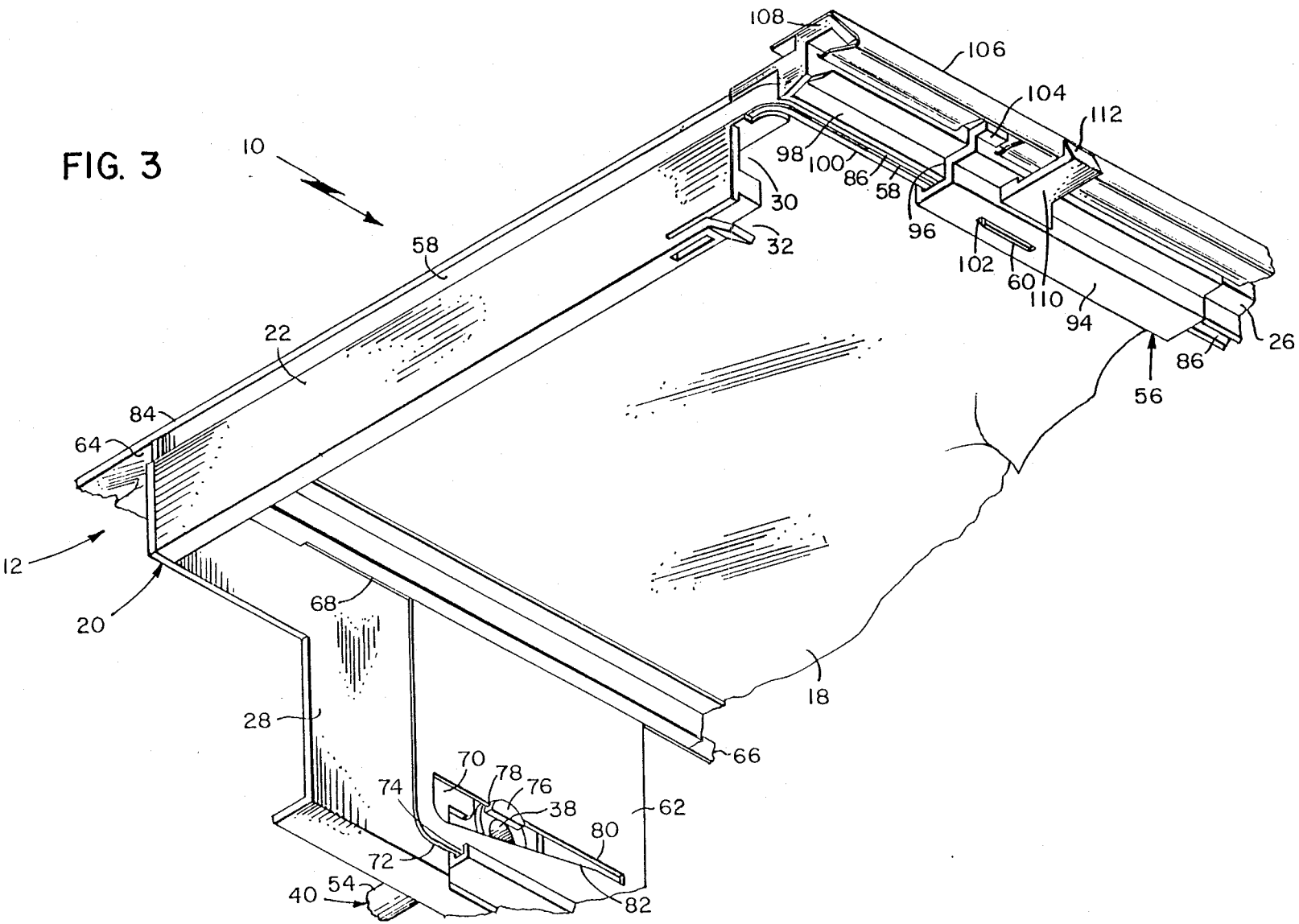
FIG. 3 is a bottom view of the meat keeper partially assembled.

Referring also to FIG. 3 which is a bottom perspective view of shelf 12 partially assembled, an air flow control mechanism 56 is provided in accordance with the invention. The air control actuator is a readily bendable band 58 or strip or ribbon of flexible plastic that has a tab 60 on one end and a shutter 62 or damper member adjacent to the opposite end. In fabrication, the tab end 60 is inserted through slot 64 in side member 22 from the inside, and then band 58 is drawn through until the shutter 62 is adjacent the inside of side member 22. Then, the tail 66 of band 58 that extends beyond shutter 62 is positioned in a guide slot 68 or channel that functions as a track for band 58. Band 58 is then pushed back along guide slot 68 until shutter opening 70 aligns with air inlet aperture 38. The shutter 62 is a substantially rectangular strip and the lower edge 72 is seated in a groove 74 of flange 44 while neck portion 76 of conduit 40 inserts through shutter opening 70 such that a groove 78 in neck portion 76 is engaged to edge 80 of shutter opening 70. Edge 80 is straight and horizontal such that shutter 62 may be slid laterally with neck portion 76 extending through shutter opening 70. Edge 82 of shutter opening 70 is inclined so that on one side of shutter opening 70 there is a relatively large spacing between edges 80 and 82, and on the opposite side there is only enough spacing for neck portion 76 to extend therebetween. Accordingly, when shutter 62 is completely to the left as shown in FIG. 3, air inlet aperture 38 is completely blocked off by shutter 62, but when shutter 62 is to the right, the large portion of shutter opening 70 aligns with air inlet aperture 38 and a maximum amount of cold air flows through conduit 40 into meat keeper 10.

The fabrication of meat keeper 10 is continued by directing the portion of band 58 extending from slot 64 forwardly along side member 22 in notch 84, and then routing the tab end 60 into channel 86 or guide slot on the underside of cross member 26. Then, side rail support bracket 88 is affixed to the outside of side member 22 using screws 90. Thus, the front-to-back portion of band 58 is captured in notch 84 between side member 22 and support bracket 88. The opposite side rail support bracket 89 is similarly attached to the opposite side member 24, and the tail 66 of band 58 is similarly captured in notch 92.

With specific reference to FIG. 3, control slide 94 has a channel 96 that seats onto and receives the runners 98 and 100 that form guide slot 86, and channel 96 has a slot 102 that receives tab 60. Control slide 94 also has locking tabs 104 that are captured underneath front trim 106 after it is snapped onto a conforming section 108 of front cross member 26. As a result, control slide 94 is engaged to cross member 26, but is free to slide laterally along runners 98 and 100 carrying the tab end 60 of band 58 with it. An operator actuable slide handle 110 extends from control slide 94 an has a projection 112 that extends up past the bottom of front trim 106.

In conventional manner, side rail support brackets 88 and 89 have hooks 114 that removably engage metal braces 19 (FIG. 1) that run up along the back wall of the refrigerated food compartment 15 thereby providing cantilever support for shelf 12 in an elevated horizontal plane within the refrigerated food compartment 15. The runners 36 of sleeve 14 are then inserted into slide channels 32, and the sleeve 14 is pushed to the rear position where it is engaged in position by bosses 116. Sleeve 14 therefore is suspended from support frame 20 and remains in this rear locked position unless it is removed for cleaning. The runners 34 of meat keeper pan 16 are then inserted into slide channels 30 and pan 16 can thereafter be slid in and out in order to provide access to the interior storage compartment 118.

Meat keeper 10 is used to store foods such as meat that desirably are maintained at a temperature below the normal temperature of the rest of the refrigerated food compartment 15. More specifically, when the large portion of shutter opening 70 aligns with air inlet aperture 38, a maximum amount of cold air from conduit 40 flows through a hole 119 in sleeve 14, and then is deflected by deflector 120. As is well known, meat keeper pan 16 seats on a ridge 122 on the bottom of sleeve 14 and therefore, the cold air migrates to exhaust port 124 of meat keeper 10 by flowing forwardly along the sides and along the bottom of meat keeper pan 16, and then rearwardly along the side and bottom to the left of ridge 122 as shown in FIG. 2. Thus, the sides and bottom of meat keeper pan 16 are bathed in a flow of cold air traveling in the space between meat keeper pan 16 and sleeve 14. In order to downwardly adjust or completely eliminate the cold air flow through sleeve 14 so as to increase the temperature within meat keeper pan 16, the operator actuates control handle 110 by pushing it laterally to the right as shown in FIG. 3. As a result, band 58 is pulled in a guide track defined by guide slots 86, the notch 84 between side rail support bracket 88 and side member 22, and guide slot 68. Accordingly, shutter 62 is pulled to the left as shown in FIG. 3, and a portion of shutter opening 70 with a smaller spacing aligns with air inlet aperture 38 such that less cold air flows through conduit 40 into sleeve 14. If control slide 94 is moved to its extreme right position, shutter 62 is moved to its extreme left position, and it completely closes off air inlet aperture 38. In such arrangement, meat keeper 10 would eventually assume the general temperature of its surrounding. In between the two extreme lateral positions of band 58, meat keeper 10 is adjustable to various degrees of coldness. Tolerances or spacings of guide slots 68 and 86, and notch 84 are selected so that in response to operator actuation of control slide 94 as coupled to tab 60, band 58 may be pushed or pulled along the corresponding track without crimping, bulging out, or binding. Although band 58 may be made from various bendable plastic materials having properties for being pushed and pulled through a guide slot with a minimum of friction and resistance, Dupont Hytrel 6356 has been found to be a very satisfactory material. It should also be understood that band 58 could be routed the entire way around frame 20 and connected to control slide 94 such that regardless of the travel direction of slide 94, band 58 would be pulled rather than being pushed in one direction.

Figure 4:
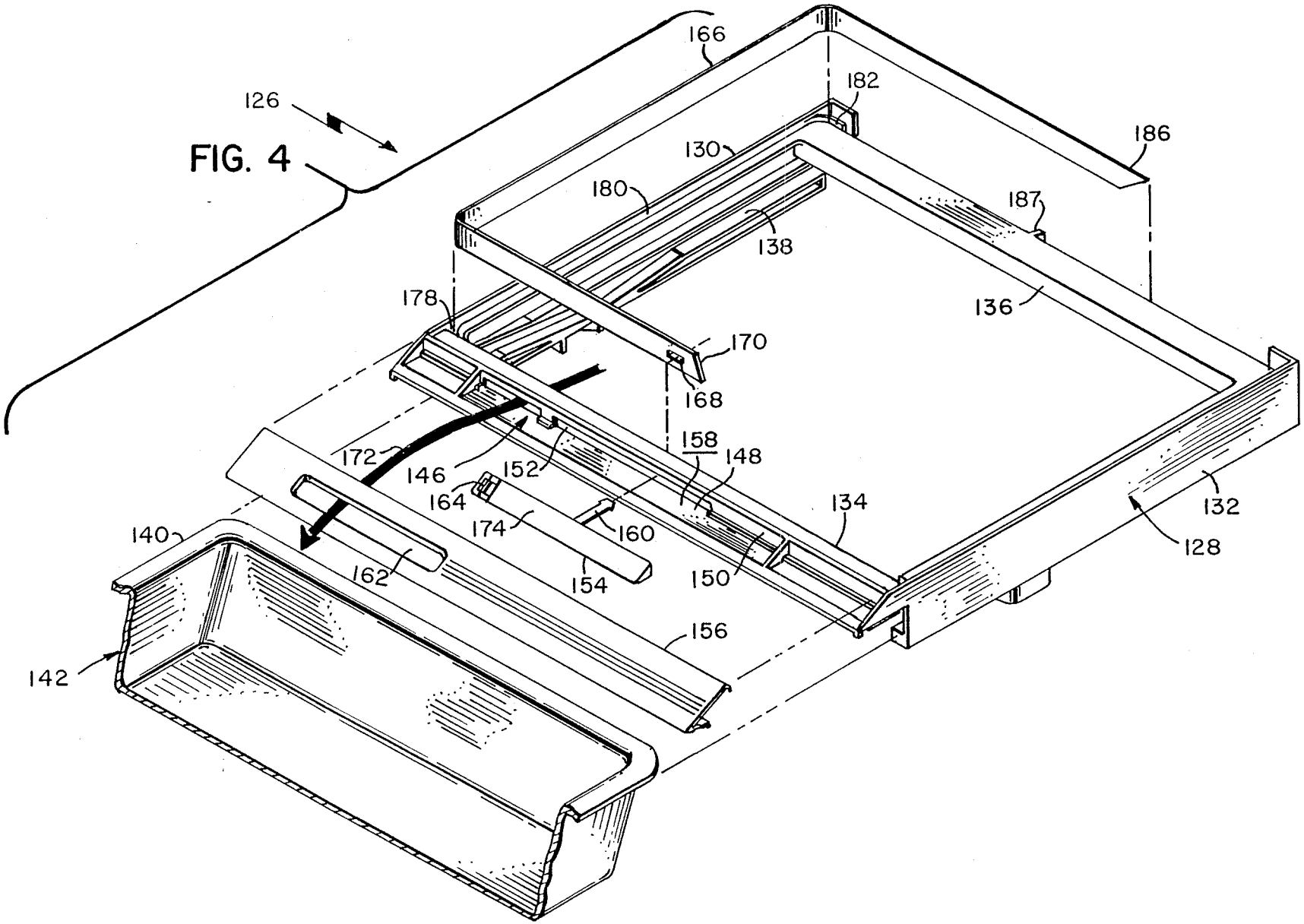
FIG. 4 is an exploded view of a crisper pan.

Referring to FIG. 4, the invention is shown in an alternate embodiment in the form of a crisper pan 126 as contrasted to meat keeper 10. As is well known, the purpose of a crisper pan 126 is to provide a storage region that has a higher humidity than the rest of the refrigerated food compartment 15, but not so high so as to cause excessive condensation and the formation of puddles. That is, if the crisper pan 126 were completely sealed and very moist lettuce heads were placed in it, puddles could form and the lettuce would become soggy on the bottom. Accordingly, it is desirable to have a relatively small adjustable flow of cold air through the crisper pan 126 using the natural convection of the refrigerated food compartment 15 from back-to-front along the bottom. In such manner, the air flow through the crisper pan 126 can be adjusted so as to provide the optimum humidity for the particular food load. For a more complete description of the air flow and the objects of a crisper pan in general, see U.S. Pat. No. 4,557,118 which is hereby incorporated by reference.

Crisper pan support frame 128 includes side members 130 and 132, a front cross member 134 and a rear cross member 136. Each of the side members 130 and 132 has a slide channel 138 adapted for receiving and supporting the runners 140 of the crisper drawer 142 or pan. Flexible flaps (not shown) may be suitably attached to the front and rear cross members 134 and 136 so that when the crisper drawer 142 is slid to the rear closed position, the drawer 142 engages the flaps so as to seal the drawer 142 except for the adjustable flow-through air path to be described subsequently.

Front cross member 134 has a notch 146 defining a floor 148 and a back wall 150 having one or more windows 152. Control slide 154, which is here a laterally elongated plastic part having a right triangle cross-section is seated on floor 148 and captured by front trim 156 which is snapped over front cross member 134 thereby defining a substantially triangular chamber 158.

Control slide 154 has a finger 160 that inserts through window 152, and front trim 156 has a lateral slot 162 through which an operator actuable handle 164 attaches to control slide 154. Finger 160 attaches to bendable band 166 by suitable means such as extending through a slot 168 in the front end 170 of band 166. Accordingly, by pushing operator actuable handle 164 laterally, control slide 154 slides laterally within chamber 158 thereby causing the front end 170 of band 166 to be pushed or pulled in a lateral direction.

A front passageway 172 from crisper pan 126 is provided through window 152 and slot 162. When control slide 154 is in the left-most position as shown in FIG. 4, the upper surface 174 of control slide 154 seals against slot 162 thereby completely closing off the front passageway 172. When control slide 154 is pushed to the right, the front passageway 172 is opened to varying degrees until it is finally in the maximum open position at its right-most extremity.

Figure 5:
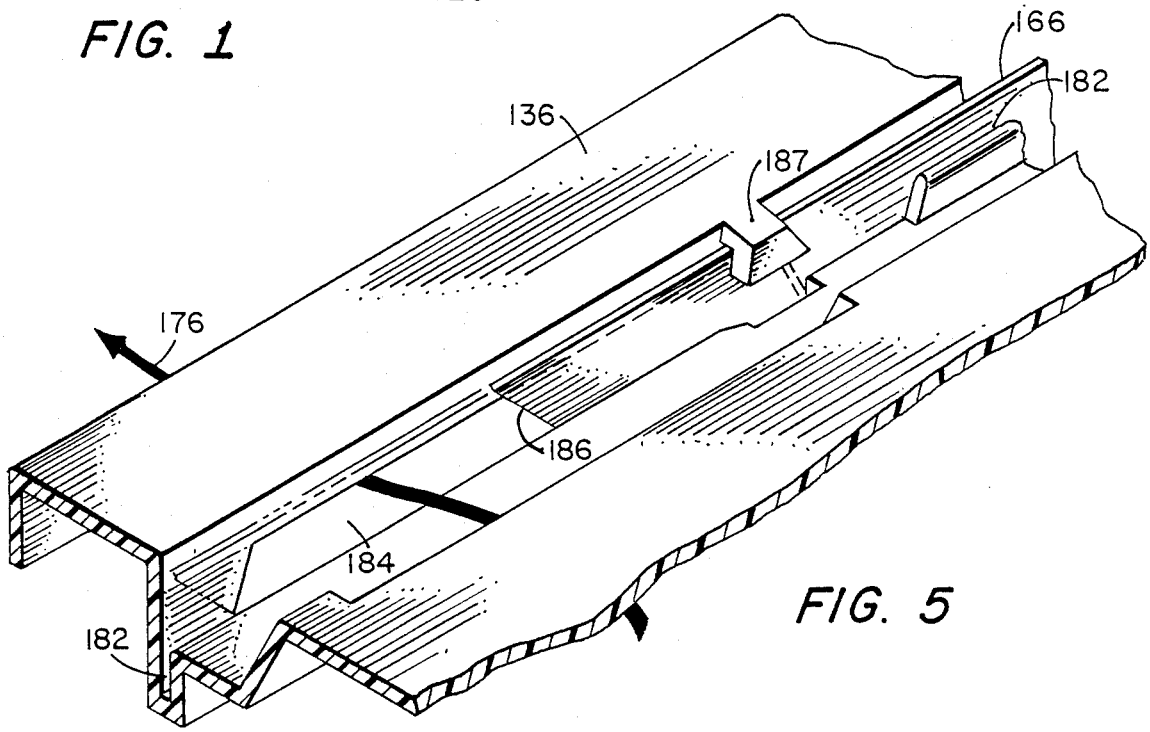
FIG. 5 is a rear perspective view of a portion of the crisper pan showing the rear air passageway.

Referring to FIG. 5, the lateral motion of band 166 in response to control slide 154 synchronously opens and closes a back passageway 176 into drawer 142. That is, band 166 or bendable plastic ribbon similar to band 58 is coupled to a guide track that goes across the front and then back along the side to the back such that lateral motion of control slide 154 at the front imparts lateral motion of band 166 in the opposite direction along the back for opening and closing back passageway 176. More specifically, band 166 is routed in guide slot 178 or channel to side member 130 and then back along guide slot 180 inside member 130 to guide slot 182 in rear cross member 136. A window 184 in the rear cross member 136 provides the back passageway 176. The back end 186 of band 166 is tapered and as it moves along guide slot 182, it passes under guide bracket 187 and moves laterally to open or close the back passageway 176. More specifically, when the front end 170 of band 166 is in the right-most position such that the front passageway 172 is open, the back end 186 or shutter of band 166 is in the left-most position, as shown in FIG. 4, such that the back passageway 176 is also open. Similarly, when the front end 170 is left and the back end 186 is right (left in FIG. 5 as depicted by dotted outline), both front and back passageways 172 and 176 are closed. In between, varying degrees of natural convection cold air is permitted to flow through the back passageway 176 and out through the front passageway 172 so as to adjust the humidity within crisper pan 126. A glass cover 188 (FIG. 1) is positioned down over support frame 128 and captures band 166 within guide slots 178, 180, and 182.

In accordance with the invention that has been shown in both meat keeper 10 and crisper pan 126 embodiments, a flexible band 58 or 166 has been captured in a guide or slide track such as a vertical slot or channel that runs back along a side member 22 or 130 so that a rear damper 62 or 186 can be actuated without having a mechanical linkage that runs back across the middle of the frame 20 or 128. Accordingly, the invention has particular advantage for use with a meat keeper 10 or crisper pan 126 that has an optically transparent top or cover such as glass because a clear unobstructed view is provided of the interior. In other words, an air inlet at the rear can be opened or closed by a damper that is easily controlled by a lateral slide at the front, without having a longitudinal actuator arm or linkage that obstructs the view through the top glass.

This concludes the Description of the Preferred Embodiment. A reading of it by those skilled in the art will bring to mind many alterations and modifications that do not depart from the spirit and scope of the invention. Accordingly, it is intended that the scope of the invention be limited only by the appended claims.

What is claimed is:

1. In combination:

a substantially rectangular horizontal frame adapted for supporting a slide-out food drawer in a refrigerator, said frame having a cover and a rear air inlet for receiving cold air, said frame further having a track extending from the front back along one side to the rear of said frame;

a flexible band slidably coupled to said track and extending from the front of said frame back along said one side to the rear of said frame;

operator actuable means for moving said flexible band along said track from the front of said frame wherein lateral motion of said band at the front imparts lateral motion of said band in the opposite direction at the rear of said frame; and damper means responsive to lateral motion of said flexible band at the rear of said frame for opening and closing said rear air inlet.

2. The combination recited in claim 1 wherein said operator actuable means comprises a lateral slide having a handle.

3. The combination recited in claim 1 wherein said cover is visibly transparent.

4. The combination recited in claim 1 wherein said damper means comprises an end portion of said flexible band.

5. The combination recited in claim 1 wherein said damper means comprises a portion of said flexible band having an aperture wherein, when said aperture is aligned with said rear air inlet, said damper means is opened.

6. The combination recited in claim 1 further comprising an outer sleeve spacedly encasing said drawer, said cold air from said rear air inlet being directed into the space between said sleeve and said drawer.

7. The combination recited in claim 1 wherein said frame further comprises a front passageway that is opened and closed by lateral movement of said operator actuable means.

8. In a refrigerator having a substantially rectangular horizontal shelf having underside slide channels adapted for supporting a food drawer in sliding engagement, and a rear inlet for receiving cold air, a control for opening and closing the rear air inlet from the front of the shelf, said control comprising:

a slide track extending from the front of said shelf back along one side to the rear of said shelf;

a bendable actuator coupled to said track and being movable along said track, said actuator having a laterally slidable operator actuable handle at the front for moving said actuator along said track; and a damper positioned at the rear of said shelf and being responsive to movement of said actuator along said track for opening and closing said rear air inlet.

9. The control recited in claim 8 wherein said slide track comprises a narrow vertically oriented channel.

10. The control recited in claim 9 wherein said bendable actuator comprises a vertically oriented flexible plastic band.

11. The control recited in claim 10 wherein said damper comprises a end portion of said flexible band.

12. The control recited in claim 10 wherein said damper comprises a portion of said flexible band having an aperture wherein, when said aperture is aligned with said rear inlet, said damper is open.

* * * * *